US005308257A

United States Patent [19]

Buchter et al.

[11] Patent Number: 5,308,257

[45] Date of Patent: May 3, 1994

[54] ZIF CARD EDGE CONNECTOR UTILIZING FLEXIBLE FILM CIRCUITRY

[75] Inventors: Randolph L. Buchter, Harrisburg; Michael A. Viselli, Middletown; Jon A. Fortuna, Mechanicsburg, all of Pa.

[73] Assignee: The Whitaker Corporation, Wilmington, Del.

[21] Appl. No.: 12,116

[22] Filed: Feb. 1, 1993

[51] Int. Cl.[5] ..... H01R 11/22

[52] U.S. Cl. ..... 439/267; 439/265

[58] Field of Search ..... 439/62, 65, 67, 259, 439/260, 261, 265, 266, 267, 630, 632, 635, 631

[56] References Cited

U.S. PATENT DOCUMENTS

| | | | |
|---|---|---|---|
| 3,102,767 | 9/1963 | Schneck . | |
| 3,401,369 | 9/1968 | Palmateer et al. . | |
| 3,609,463 | 9/1971 | Laboue | 317/101 DH |
| 3,614,707 | 10/1971 | Kaufmann et al. . | |
| 3,772,775 | 11/1973 | Bonnke et al. | 29/628 |
| 3,922,054 | 11/1975 | Dechelette . | |
| 4,517,625 | 5/1985 | Frink et al. | 361/399 |
| 4,629,270 | 12/1986 | Andrews, Jr. et al. . | |
| 4,840,575 | 6/1989 | Matsuoka | 439/267 |
| 4,911,643 | 3/1990 | Perry et al. | 439/67 |
| 4,911,653 | 3/1990 | Walton et al. | 439/326 |
| 4,969,824 | 11/1990 | Casciotti | 439/67 |
| 5,098,309 | 3/1992 | Deak et al. | 439/260 |
| 5,133,667 | 7/1992 | Daughtrey | 439/67 |
| 5,156,553 | 10/1992 | Katsumata et al. | 439/62 |
| 5,171,154 | 12/1992 | Casciotti et al. | 439/260 X |

*Primary Examiner*—Larry I. Schwartz
*Assistant Examiner*—Khiem Nguyen
*Attorney, Agent, or Firm*—William B. Noll; Bruce J. Wolstoncroft

[57] ABSTRACT

The present invention is directed to a ZIF card edge connector utilizing flexible film circuitry, where a daughter board, for example, may be electrically connected to a mother board upon which the connector is surface mounted. The connector preferably comprises an elongated housing consisting of a base, a pair of spaced apart side walls upstanding therefrom, and a pair of end walls to define the elongated slot. Placed therewithin is a U-shaped spring member where its arms upstand near the side walls. To effect opening and closing of the connector, a card release slide member is disposed within the U-shaped spring member in contact with the spring member arms, where the card release slide member is adapted to shift longitudinally to effect a lateral movement of the spring member arms. At least one release member is mounted in an end wall to effect the shifting of the card release slide member. However, a pair of cooperating slide members, one in each end wall, may be provided. Finally, a flexible film, having electrical circuitry interconnecting means thereon, is disposed in a loop between the arms of the spring member within the elongated slot, whereby a printed circuit board card, i.e., daughter board, having circuitry thereon for registration with the circuitry of the flexible film, may be inserted into the loop.

9 Claims, 6 Drawing Sheets

ZIF CARD EDGE CONNECTOR UTILIZING FLEXIBLE FILM CIRCUITRY

BACKGROUND OF THE INVENTION

This invention is directed to a zero insertion force (ZIF) card connector in which a flexible film having electrical circuitry thereon is disposed therein for receiving a printed circuit board (PCB) card.

The use of flexible film i.e., printed circuitry on this insulating material such as polyester film, to interconnect one circuitry to another whereby to provide a means to achieve extremely high density interconnections is known in the art. Further, flexible film circuitry provides impedance matching and thus transmission line characteristics. connectors using such film are known from several patents dating back to the early 1960's. U.S. Pat. No. 3,102,767 is one such disclosure. Subsequently issued patents include U.S. Pat. No. 3,609,463 wherein a spring biased push member is utilized to urge the contacts on a flexible material against an inserted card. In this and other disclosures, e.g., U.S. Pat. No. 3,401,369, the card is inserted against the biased film, i.e., an insertion force is required. During insertion, the circuit pads on the film and card rub or wipe against each other to clean away debris and the like.

Zero insertion force card edge connectors are known from U.S. Pat. Nos. 3,614,707 and 3,922,054. Cards are inserted without force by spreading apart the side walls defining the slot. Spring members, being either separate components or forming an integral part of the connector, e.g., as shown in U.S. Pat. No. 3,922,054, provide a biasing force to urge the film against the card when the connector is closed.

U.S. Pat. No. 4,629,270 represents a later approach to provide a ZIP connector. The connector thereof comprises a base member for mounting on a circuit with a card receiving space therealongside, actuator means with cams thereon slidably mounted for longitudinal travel on the base member, and a module having one surface for receiving a free side of a flexible film. Additionally, there is one or more cam followers, with the module being mounted so that the one surface faces the card receiving space and the one or more cam followers cooperate with the cams so that by moving the actuator means longitudinally, the module moves laterally towards and away from the card receiving space and further perpendicularly relative to the base member.

SUMMARY OF THE INVENTION

The invention relates to a ZIF card connector in which a flexible film having electrical circuitry thereon is disposed within the connector for receiving a PCB card. The connector comprises an elongated housing consisting of a base, a pair of spaced apart side walls upstanding therefrom, and a pair of end walls to define an elongated slot. Within such slot a U-shaped spring member is disposed where its arms upstand near the side walls. A card release slide member is provided within the U-shaped spring member in contact with the spring member arms, where the card release slide member is adapted to shift longitudinally to effect a lateral movement of the spring member arms. At least one release member is mounted in an end wall to effect the shifting of the card release slide member. Finally, a flexible film, having electrical circuitry interconnecting means thereon, is disposed in a loop between the arms of the spring member within the elongated slot, whereby a printed circuit board card, having circuitry thereon for registration with the circuitry of said flexible film, may be inserted into the loop. In a preferred embodiment, the U-shaped spring member is embossed to coact with complementary ridges and valleys along the sides of the card release slide to effect closing and opening of the spring member.

DETAILED DESCRIPTION OF PREFERRED EMBODIMENTS

Figure 1:
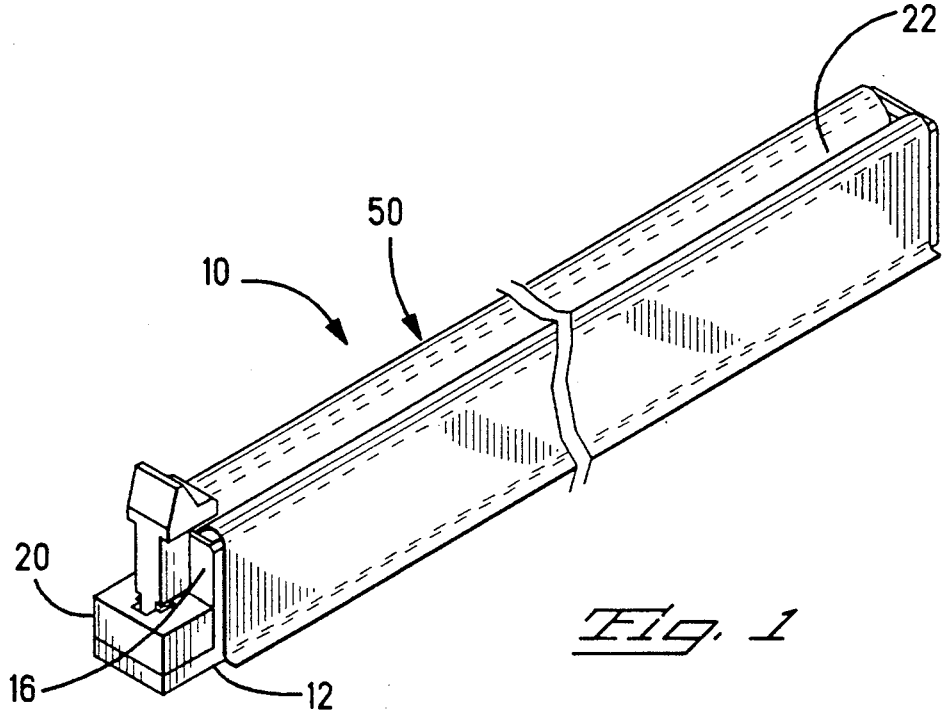
FIG. 1 is perspective view of a ZIF connector according to this invention.
Figure 2:
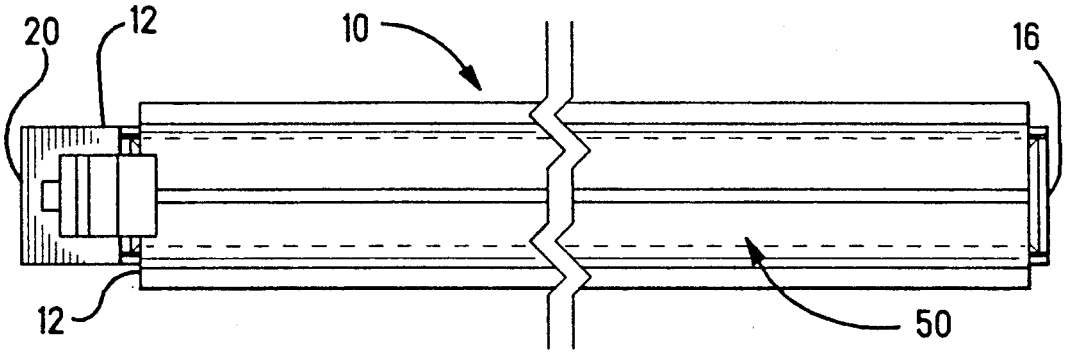
FIG. 2 is a top view thereof.

The invention, as best illustrated in the several Figures, relates to a zero insertion force (ZIF) card connector 10 comprising an elongated housing including a base 12, a pair of upstanding, parallel side walls 14, and a pair of end walls 16, where at least one of the end walls includes an opening 18 for receiving an axial slide member 20.

Figure 5:
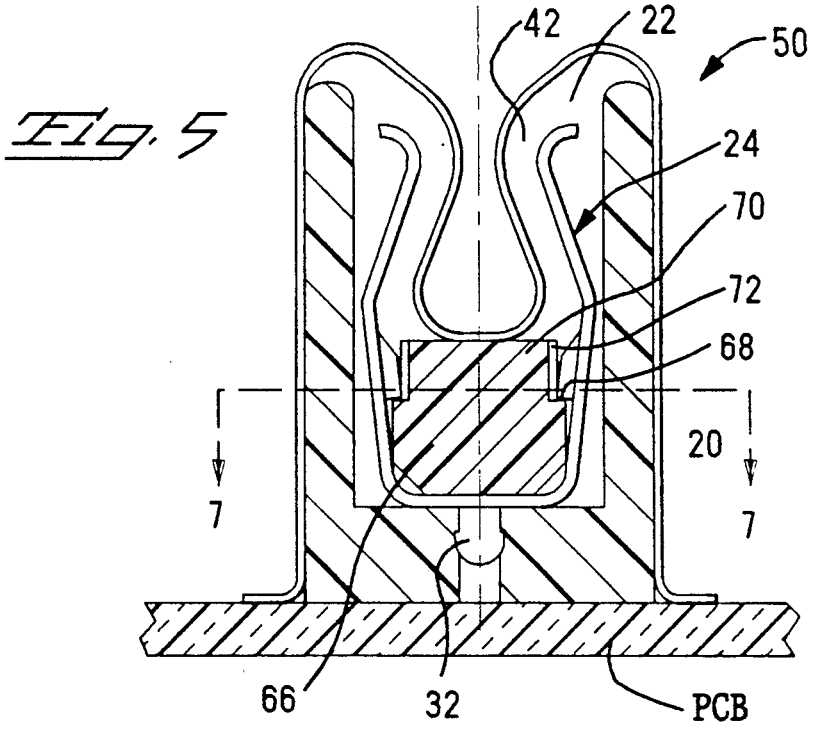
FIG. 5 is a sectional view of the ZIF connector of this invention, showing the open position thereof for receiving a PCB card.
Figure 6:
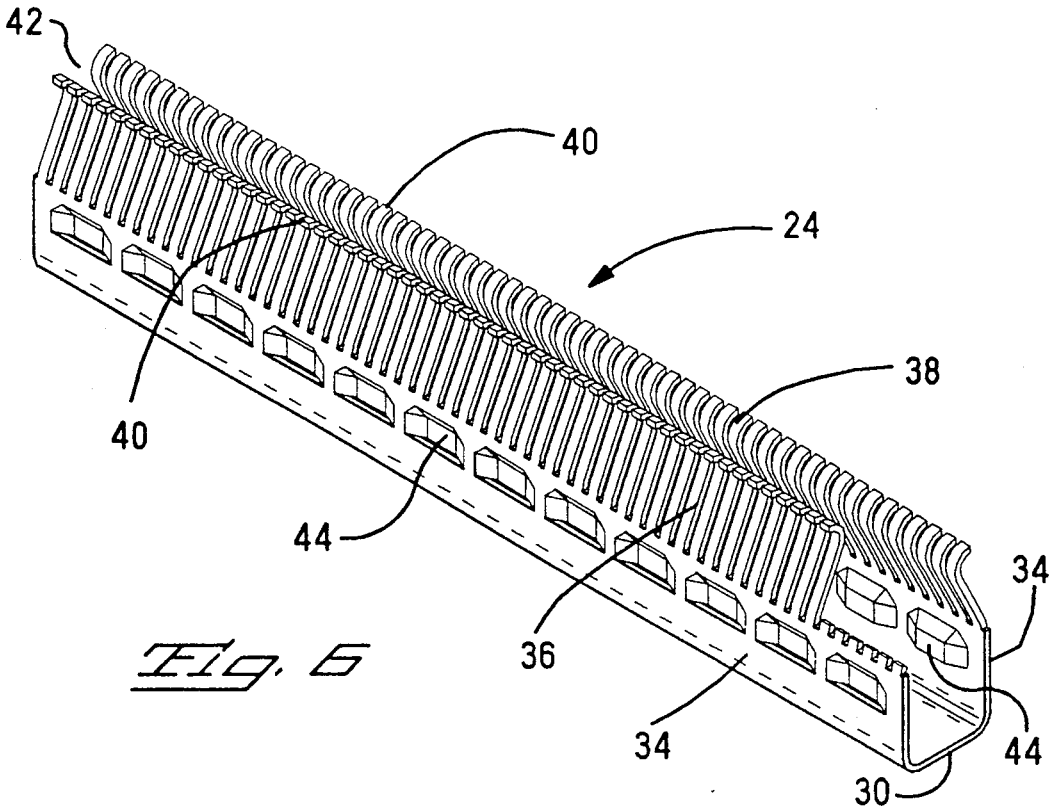
FIG. 6 is a perspective view of a preferred spring member for the connector of this invention.

Within the cavity 22 defined by the parallel side walls and the end walls, a U-shaped spring member 24 is provided, see FIG. 6. Such spring member 24 may be stamped and formed from a sheet metal blank of a metal having spring properties, or formed of a plastic material having spring properties. The formed spring member 24 includes a base 30 having struck therefrom one or more tabs 32 (see FIG. 5), for securing the spring base 30 to complementary slots in the housing base 12. Upstanding therefrom are a pair of side walls 34 where the upper half thereof is preferably characterized by plural, spaced apart spring arms 36, the ends 38 of which are outturned 40 toward the housing side walls 14 to provide a spaced apart opening 42 therebetween. Finally, along the lower portion of spring walls 34, the walls are embossed 44 to define plural peaks and valleys, see FIG. 6. As will be apparent in the description which follows, such peaks and valleys cooperate with comparable peaks and valleys on the axial slide member 20 to effect opening and closing of the spring member 24.

Figure 3:
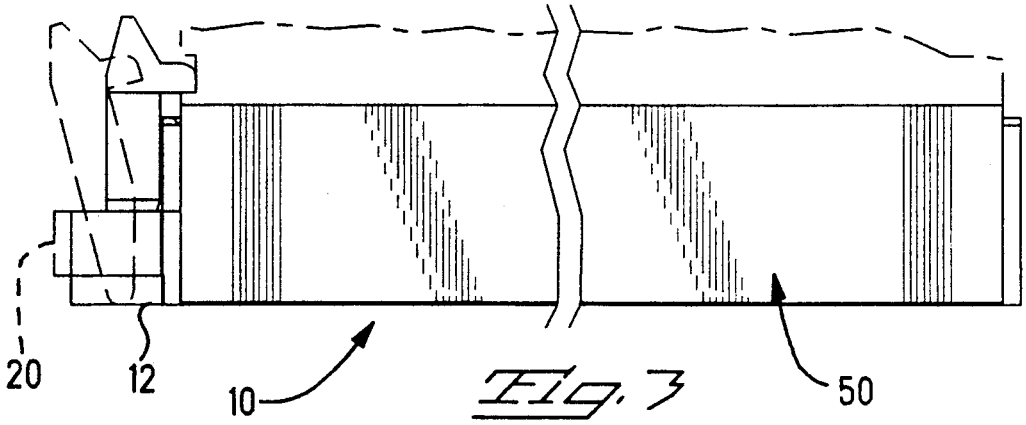
FIG. 3 is a front view of the ZIF connector of FIGS. 1 and 2, showing in phantom lines a PCB card received therein, and the means for securing same.
Figure 4:
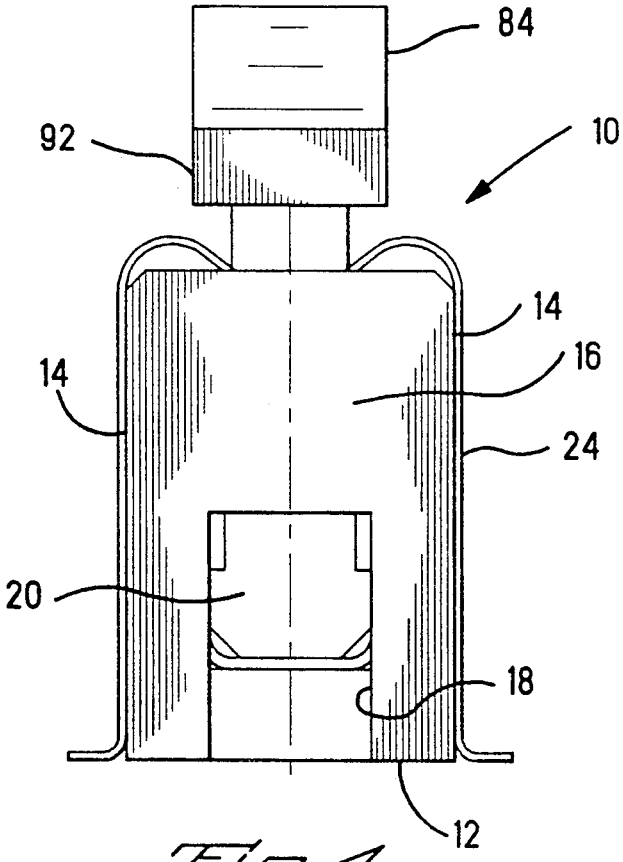
FIG. 4 is an end view thereof.
Figure 9:
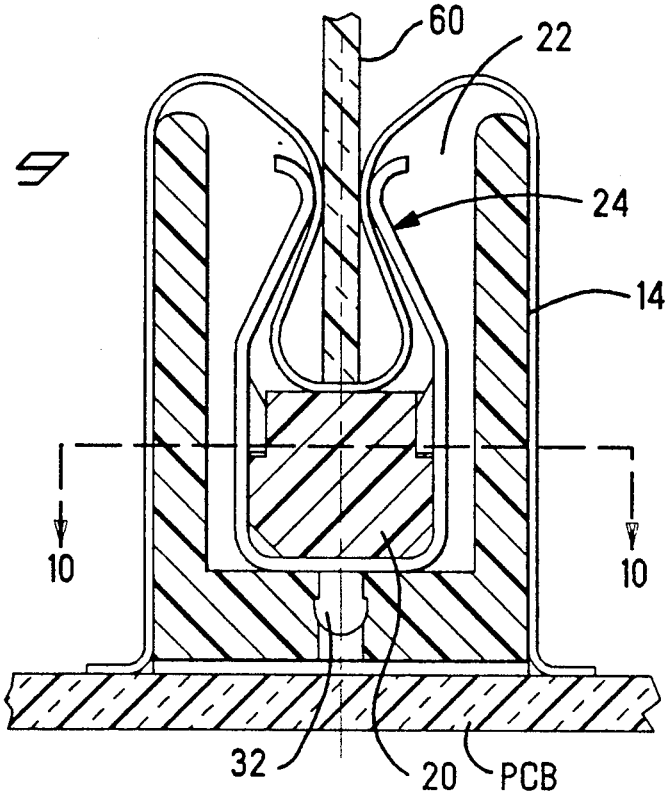
FIG. 9 is a sectional view similar to FIG. 5 showing the "closed" connector of this invention, with a PCB card received therein.

Disposed within the spring opening 42 is a flexible film 50, having electrical circuitry thereon, as known in the art and as best seen in FIG. 3. It will be observed that the flexible film 50 lies adjacent to the side walls 14 then turns 90° to lie against an underlying member, such as a printed circuit board (PCB) or cable, as known in the art, FIGS. 4, 5 and 9. That is, the connector of this invention is intended to interconnect circuits on both sides of a card 60 (FIG. 9) to circuits on a PCB through circuits on flexible film 50. However, it will be understood that in certain circumstances it may be desirable to interconnect circuits on only one side of the card 60 to the PCB, and the connector of this invention can be so applied.

Figure 7:
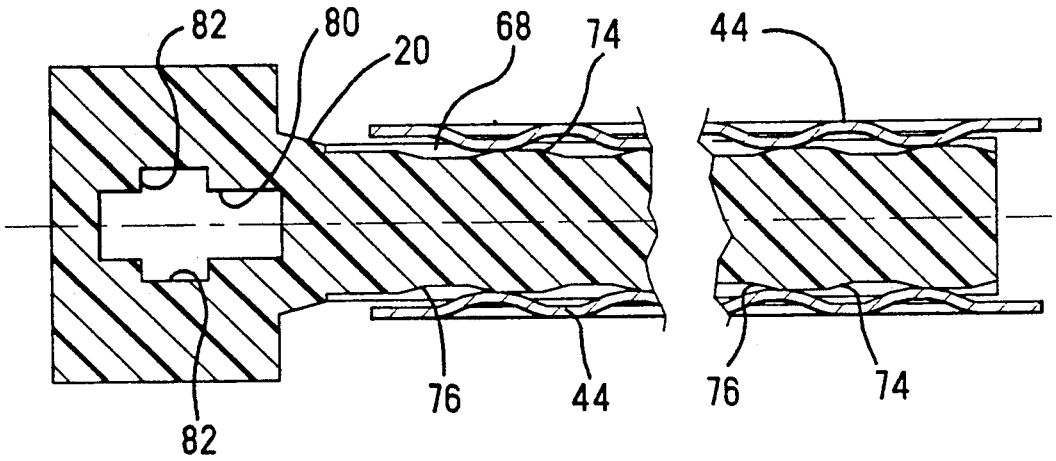
FIG. 7 is a sectional view taken along line 7—7 of FIG. 5.
Figure 10:
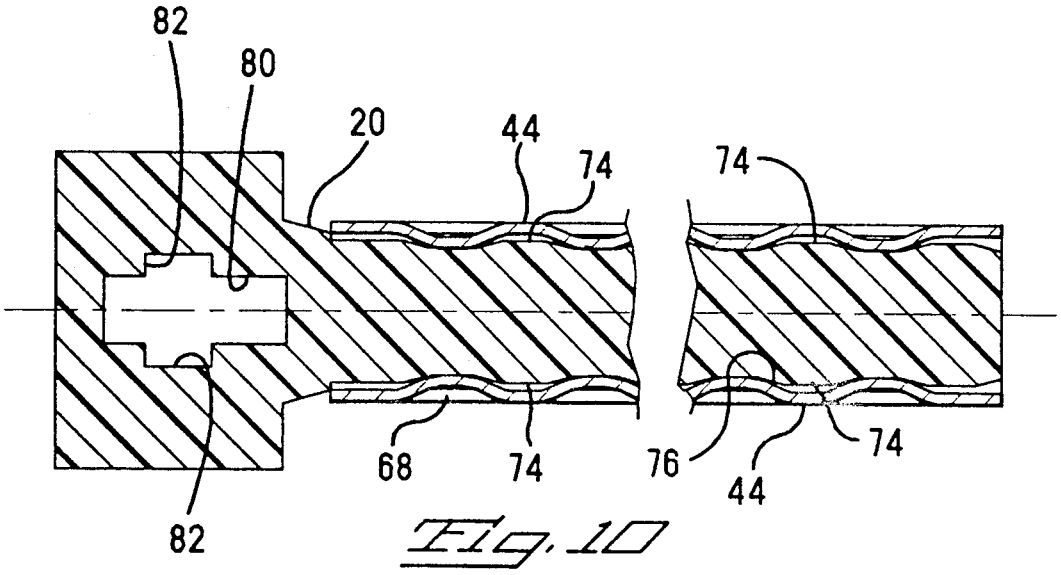
FIG. 10 is a sectional view, similar to FIG. 6, and taken along line 10—10 of FIG. 8, showing coaction of the spring member and card release slide member to effect "closing" of the ZIF connector.

A critical feature of this invention is the axial slide member 20 and the manner by which it coacts with the spring member 24 to effect opening and closing of such spring member. The slide member 20, molded of a dielectric material, or in the alternative diecast from a metal, comprises an elongated portion 66 dimensioned to seat within the spring member 24 adjacent the spring base 30 and between the lower portion of the spring side walls 34. The slide member 20 is further provided with a pair of axially arranged shoulders 68 along each side thereof to reveal an upper portion 70 having a reduced lateral dimension. Along the side walls 72 of this upper portion, plural, spaced-apart bumps 74 are provided, see FIGS. 7 and 10. The profile of such bumps, which include sloped side walls 76, is consistent with the embossing along the spring wall so that a smooth coaction therebetween can be realized. That is, the coaction is a camming operation between the slide member 20 and the spring member 24. In the "open" position the respective peaks are laterally aligned (FIG. 7), whereas to "close" the spring arms 36 and allow the spring member 24 to resile into a position to move the circuitry on the flexible film against the circuit pads on the card (FIG. 9), the peaks of the spring member are laterally aligned with the corresponding valleys of the slide member (FIG. 10).

Figure 8:
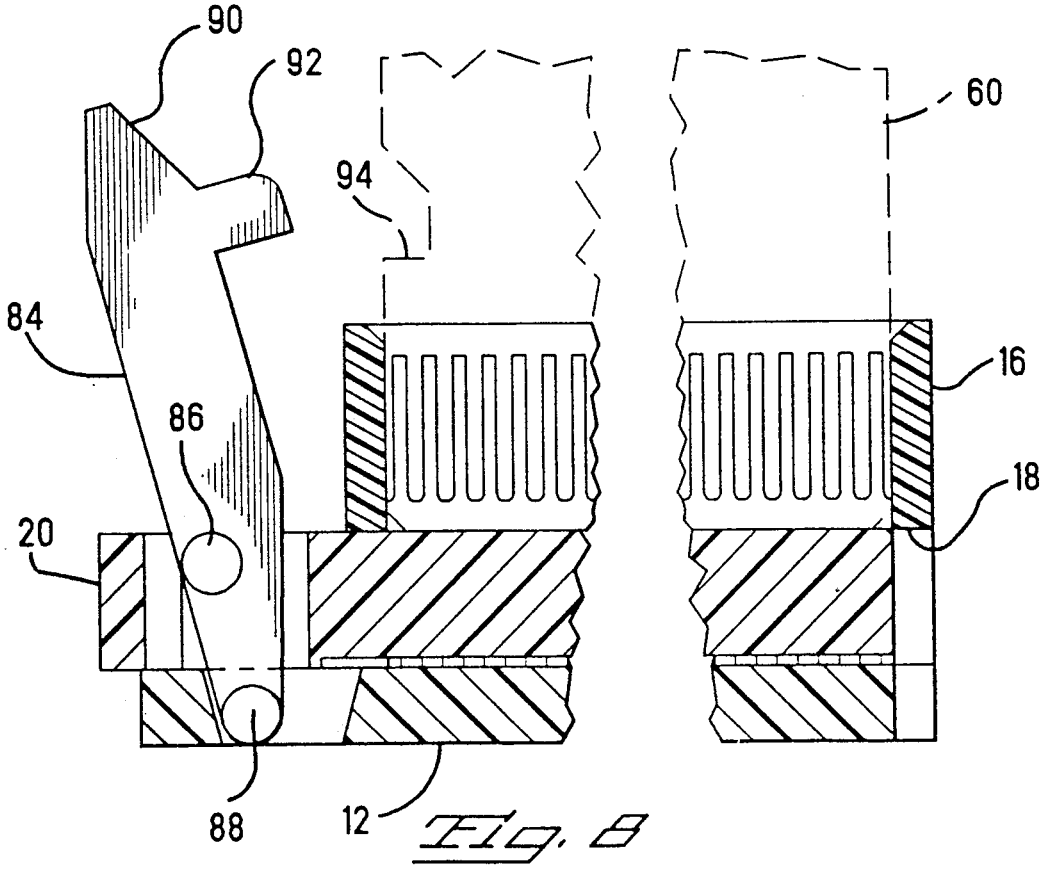
FIG. 8 is a partial sectional view of the "open" ZIF connector of this invention, showing the lever mechanism to effect closing thereof.
Figure 11:
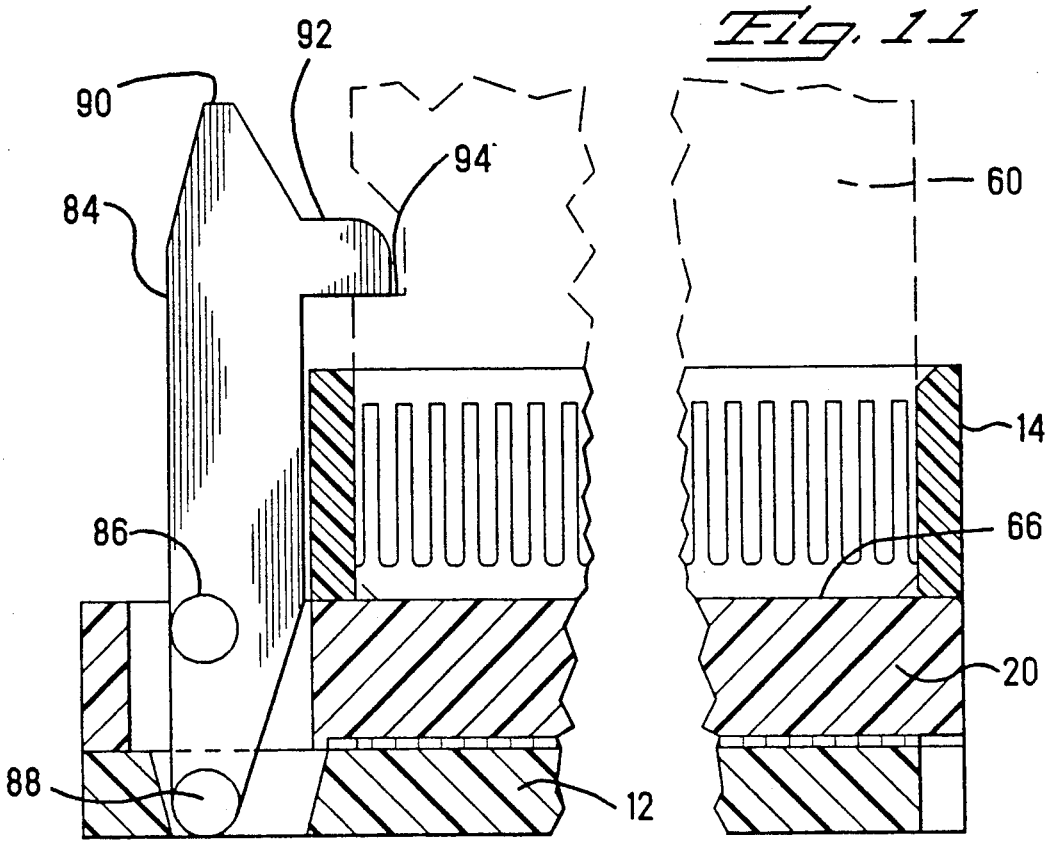
FIG. 11 is a partial sectional view, similar to FIG. 8, showing the "closed" position.

To effect axial movement of the slide member 20, at least one end of the elongated portion 66 is provided with a lever receiving slot 80, where such slot includes a pair of slot extensions 82 for receiving lever 84, more particularly the lever arms 86. The lever 84, as seen in FIGS. 8 and 11, is pivotally mounted 88 in the housing base 12, pivotal from the "open" position shown in FIG. 8 to the "closed" position shown in FIG. 11. Briefly, as the lever 84 is pivoted, the lever arms 86, acting within the slot extensions 82, axially move or shift the slide member 20, as desired. Finally, at the remote end 90 of the lever 84, a card locking arm 92 may be provided to be received into a card slot 94. By this arrangement, premature movement or withdrawal of the card 60 is prevented. It will be appreciated that a pivotal lever may be incorporated into each end wall, particularly for long connectors to reduce the frictional forces as the respective peaks and valleys override one another.

To assemble the connector 10, the spring member 24 is inserted into the cavity 22 and seated therewithin and locked by engaging the tab(s) 32 into complementary slot(s) in the housing base 12. Thereafter, the slide member 20 is inserted through the end wall opening 18, then pushed downwardly within the spring member. As the slide member 20 is pushed down, the shoulders 68 will underlie the embossments of the spring member thereby preventing the slide member from lifting out of position. While the connector is in the "open" position (FIG. 5), the flexible film 50 is placed within the spring opening 42 in the manner illustrated. Finally, the lever 84 may be mounted for pivotal movement within the housing base 12. In this position the connector is ready to receive card 60.

Figure 12:
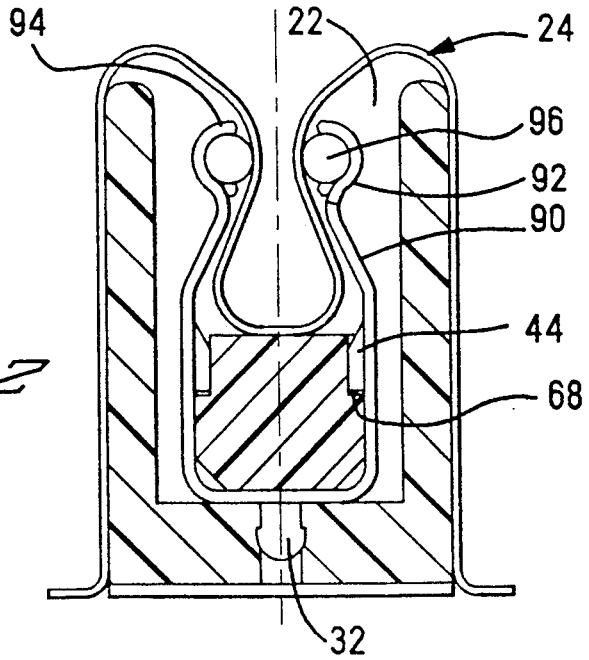
FIG. 12 is a sectional view, similar to FIG. 5, showing an alternate embodiment for the U-shaped spring member in which an elongated flexible support, such as a canted coil spring or elastomeric pad is employed.

While the embodiment represented by FIGS. 5 to 11 depict the preferred approach, FIG. 12 illustrates an alternate embodiment for the spring member 90. In this embodiment the spring arms 92 are inwardly curved 94 to receive a pair of axially arranged, opposing elongated supports 96, such as a canted coil spring or elastomeric pad. In this preferred embodiment the spring member supporting canted coil springs 96 applies a uniform pressure along the overlying flexible film 24. A canted coil spring, as known in the art, is a device that provides uniform and constant force over a large range of spring deflections. With a large deflection range, the connector hereof can accommodate cards of varying thickness. While canted coil springs may be formed of different metals, a preferred metal herein is stainless steel. The elongated elastomeric pad supports the film in a similar manner.

We claim:

1. A zero insertion force card edge connector utilizing flexible film circuitry, comprising an elongated housing consisting of a base, a pair of spaced apart side walls upstanding therefrom, and a pair of end walls to define an elongated slot, a U-shaped spring member disposed within said elongated slot, where the spring member having spring member arms provided proximate the side walls, a card release slide member disposed within said U-shaped spring member in contact with said spring member arms, where said card release slide member is adapted to shift longitudinally to effect a lateral movement of said spring member arms, at least one release member mounted in an end wall to effect the shifting of said card release slide member, and a flexible film, having electrical circuitry interconnecting means thereon, disposed in a loop between the arms of said spring member within said elongated slot, whereby a printed circuit board card, having circuitry thereon for registration with the circuitry of said flexible film, may be inserted into said loop.

2. The zero insertion force card edge connector according to claim 1, wherein said U-shaped spring member is stamped and formed from a blank of sheet metal having spring properties, said spring member having lower arms, said card release slide member having ridges and valleys along the sides thereof, the lower arms are laterally embossed to coact with complementary ridges and valleys along the sides of said card release slide member to effect closing and opening of said arms when said card release slide member is shifted.

3. The zero insertion force card edge connector according to claim 1, wherein said U-shaped spring member is formed from a plastic having spring properties, said spring member having lower arms, said card release slide member having ridges and valleys along the sides thereof, the lower arms are laterally embossed to coact with complementary ridges and valleys along the sides of said card release slide member to effect closing and opening of said arms when said card release slide member is shifted.

4. The zero insertion force card edge connector according to claim 1, wherein said release member is pivotally mounted within said end wall for movement toward and away from said elongated slot.

5. The zero insertion force card edge connector according to claim 4, wherein said release member includes a projection for locking engagement with a complementary notch within the edge of said printed circuit board card.

6. The zero insertion force card edge connector according to claim 1, wherein said spring member arms are arranged to receive a pair of longitudinally disposed elastic support members in contact with said flexible film to provide a uniform and constant force thereagainst.

7. The zero insertion force card edge connector according to claim 6, wherein said elastic support members comprise canted coil springs.

8. The zero insertion force card edge connector according to claim 6, wherein said elastic support members comprise elastomeric pads.

9. The zero insertion force card edge connector according to claim 2, wherein said card release slide member includes a pair of longitudinally disposed shoulders which underlie the embossed portion of said spring member.

* * * * *